US005591091A

United States Patent [19]

Hackman

[11] Patent Number: 5,591,091

[45] Date of Patent: Jan. 7, 1997

[54] METHOD OF MATCHING A GOLFER TO A GOLF CLUB

[76] Inventor: Lloyd E. Hackman, 1322 Clubview Blvd. S., Worthington, Ohio 43085

[21] Appl. No.: 511,090

[22] Filed: Aug. 3, 1995

[51] Int. Cl.[6] ..... A63B 53/12

[52] U.S. Cl. ..... 473/289; 473/407; 473/409

[58] Field of Search ..... 273/77 A; 473/289, 473/409, 407

[56] References Cited

U.S. PATENT DOCUMENTS

| | | | |
|---|---|---|---|
| 307,501 | 11/1884 | Stanwood . | |
| 307,917 | 11/1884 | Cox . | |
| 4,122,593 | 10/1978 | Braly | 29/407 |
| 5,351,952 | 10/1994 | Hackman | 473/289 X |
| 5,441,256 | 8/1995 | Hackman | 473/289 X |
| 5,478,073 | 12/1995 | Hackman | 473/289 |

FOREIGN PATENT DOCUMENTS

| | | | |
|---|---|---|---|
| 2660202 | 10/1991 | France | 273/77 A |
| 1045614 | 10/1966 | United Kingdom | 273/77 A |

*Primary Examiner*—George J. Marlo
*Attorney, Agent, or Firm*—Frank H. Foster; Kremblas, Foster, Millard & Pollick

[57] ABSTRACT

The club length and club frequency attributes of each of a plurality of golf clubs in inventory are obtained and the data are arranged in a two dimensional array. The golfer's swing frequency for a test club of a particular test club length is measured. An inventory club is selected, from the inventory array having substantially the same length as the test club and having the closest frequency to the golfer's swing frequency of any inventory club in that array of that length.

This process can be employed for one or more clubs. Alternatively, only a few club lengths can be tested to obtain swing frequencies for those clubs. The swing frequencies of any intermediate, untested club lengths are interpolated by standard numerical analysis or obtained by plotting the data points and connecting them with a curve.

12 Claims, 8 Drawing Sheets

METHOD OF MATCHING A GOLFER TO A GOLF CLUB

TECHNICAL FIELD

This invention relates to methods of matching a golfer to a golf club, and specifically to matching a golf club having a natural frequency which corresponds to the golfer's swing frequency.

BACKGROUND ART

Golfers have a swing frequency associated with the swing of each golf club in a set. The golfer's swing frequency is inversely related to the time of a particular portion of the golfer's normal swing of a club. When the golfer begins his downward swing, he raises the club above his head and then he pulls his arms downwardly toward the ball, thereby accelerating the club. As the downward swing begins, the club flexes backwardly, due to the inertia of the club head tending to remain in place, thereby storing potential energy in the bent club shaft. When the acceleration of the club head reaches a maximum and begins to decrease, the club shaft begins to flex forward and straighten out. This motion is similar to a pendulum passing through its lowest point. The club head has maximum velocity and zero acceleration with respect to the axis of its grip when the shaft has sprung from bent and is passing through the point of its oscillation cycle in which the club shaft is straight. At ball impact, the club head velocity is the sum of its velocity with respect to the grip axis plus the velocity from the motion of the grip axis itself moving approximately circularly in the golfer's hands. Preferably, the club shaft is straight at ball impact, so as to impart maximum momentum to the ball as a result of the club head velocity being maximum when the shaft is straight.

Each particular golf club has a natural frequency at which it will oscillate if it is held at the grip end, bent and released. This is the frequency at which the above described oscillation occurs. It is desirable to match a golfer's swing frequency to the natural frequency of each club in his set so that at ball impact each club shaft is straight.

The swing frequency phenomenon is explained more fully in U.S. Pat. Nos. 5,351,952, 5,441,256 and 5,478,073 to Hackman. These applications and patent describe how swing frequency can be measured. The time that elapses between the time at which club head acceleration is at a maximum and the time of ball impact (at which time acceleration takes a characteristic plunge to negative acceleration) is called swing time, t. Swing time is the time interval in the golfer's swing during which it is desired that approximately one-fourth of an oscillation cycle of the golfer's club occurs to make the club shaft straight at ball impact. It must be assumed that the time from when the club begins to straighten out (at maximum acceleration) until the club shaft is straight (at acceleration of zero) is approximately one-fourth of an oscillation cycle of the golf club. The swing frequency therefore equals one-fourth cycle divided by the amount of time it takes for the club shaft to straighten—which is the swing time, t:

$$\text{frequency}=1/(4t)\text{tm} \quad \text{(EQUATION 1).}$$

Since a person swinging a golf club does not exert on the club a perfectly sinusoidal driving force, a correction factor, k, is necessary to accommodate the imperfections. The above equation then becomes $$\text{frequency}=k/(4t)\ \text{tm} \quad \text{(EQUATION 2).}$$

Swing frequency can be obtained by measuring the swing time, t from maximum acceleration until ball impact and inserting that time quantity into Equation 1, or Equation 2 if k has been determined.

Currently, clubs must be custom made in order to exactly match a golf club to a golfer's swing. One type of custom matching invention is shown in U.S. Pat. No. 4,122,593 to Braly. Custom making golf clubs involves measuring the swing frequency of the golfer for each particular club length, cutting a club shaft to a particular length while maintaining the desired natural frequency, and assembling the club from multiple parts, including the shaft. This method is labor intensive and it is difficult in this process to correctly cut the club shaft to the length which will give it the desired final frequency. Furthermore, a significant amount of time elapses between the initial measuring of the golfer's swing and completion of the custom made set of clubs. This waiting period adds to the disadvantage of this relatively expensive process.

The other method currently used to match a golfer to a golf club is somewhat inaccurate. This method involves the golfer choosing which one of four stiffness categories he or she wants the set of clubs to have. The stiffness categories are normally denominated, in order from most flexible to stiffest, LADIES, REGULAR, STIFF and EXTRA STIFF. Once the golfer determines which category suits him or her best, one club of each type (e.g. iron, wood) is selected from that chosen stiffness category to make up a set.

The reason this method is inaccurate is that each club in each category may vary widely in natural frequency from every other club in that same category. For example, a person comparing two nine iron, regular stiffness clubs may find that one differs in natural frequency of oscillation from the other by as much as 10 or 20 cycles per minute. A golfer may swing a regular stiffness 9 iron sample club and prefer the "feel" of it. The golfer may order one expecting a similar "feel", but get a club having a frequency varying substantially from the club he had swung.

Most golfers'swing frequencies vary between five cycles per minute and fifteen cycles per minute from swing to swing. Therefore, it is desirable to match the golfer's swing frequency to the natural frequency of a particular club within four cycles per minute. The time from measuring the golfer's swing frequency until receipt by the golfer of the clubs should be very low and the cost, as compared to custom fitting of clubs, should be low.

BRIEF DISCLOSURE OF INVENTION

This is a method for manufacturing an inventory of golf clubs and matching a golfer to a golf club from that inventory. The method comprises a first step of manufacturing an inventory array of golf clubs. Each inventory golf club has attributes of club length and natural frequency. Furthermore, the inventory clubs include clubs at discrete intervals of length and at discrete intervals of frequency in a two-dimensional array of club length and club frequency attributes. A second step of the method is the step of measuring the swing frequency of the golfer's swing with a test club. The test club has a club length substantially equal to a length of an inventory club which is preferably a length suitable for the stature of the golfer and the club type being used. A third step of the method includes selecting for the golfer an inventory club having a length substantially equal to the test club length and having a natural frequency which is closer to the golfer's measured swing frequency than any other club in the inventory array which has length substantially equal to the test club length.

The invention contemplates repeating the second and third steps for a plurality of different club lengths.

The invention also contemplates storing the length and frequency attributes of each inventory club as a data structure in a memory of a computer. Furthermore, the preferred discrete intervals of length are approximately one-half inch, and the preferred discrete intervals of frequency are approximately eight cycles per minute which allows any fitting of a club to within four cycles per minute.

Figure 1:
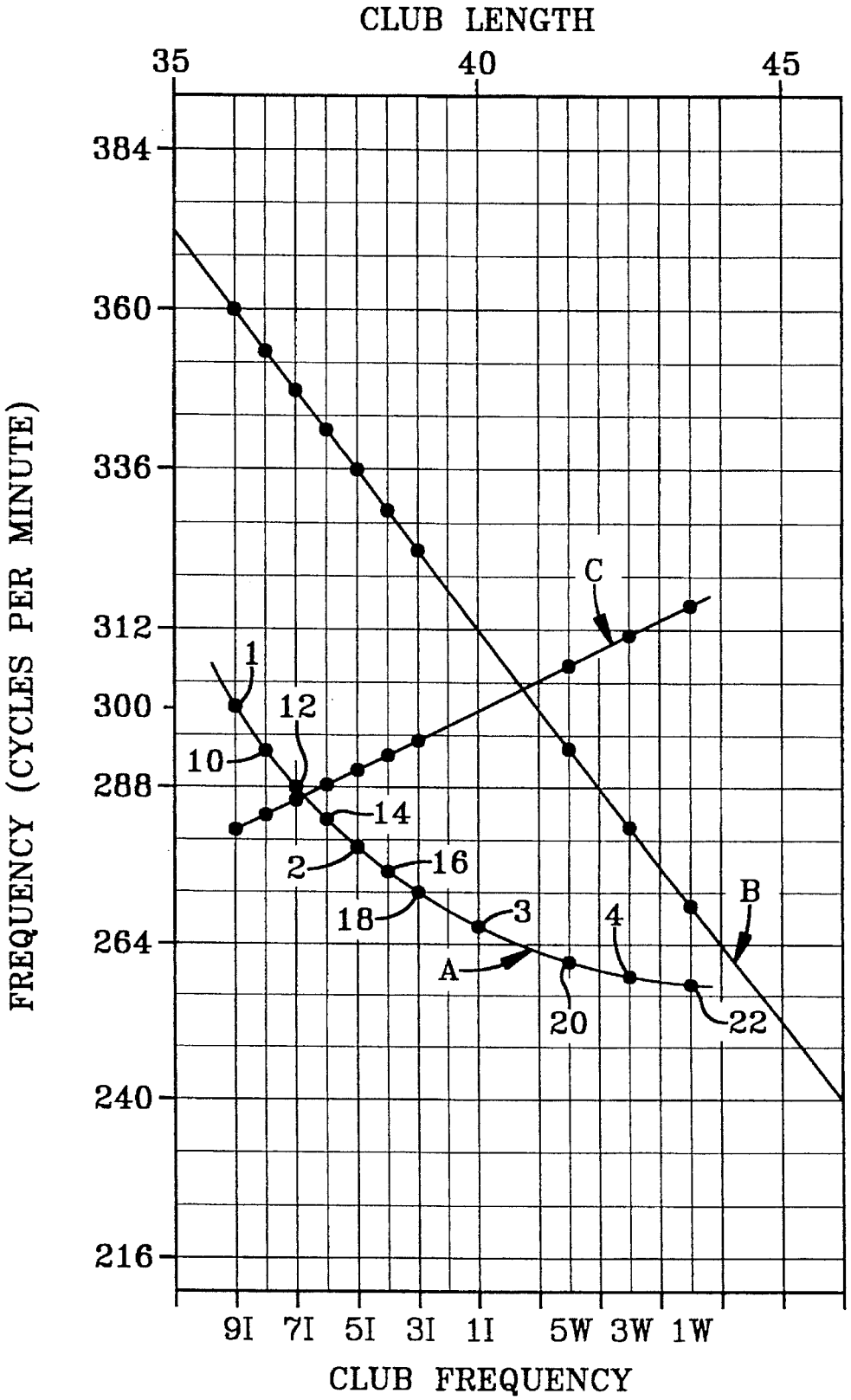
FIG. 1 is a graph illustrating one embodiment of a two-dimensional array of data.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

The present invention is a method involving, in its simplest embodiment, three basic steps: manufacturing, measuring, and selecting. The steps are preferably performed by first manufacturing a plurality of inventory golf clubs. The length and frequency attributes of each inventory club is known and stored. Secondly, a golfer's swing frequency is measured for each club length the golfer desires. Finally, an inventory golf club is selected which corresponds to the measured swing frequency. The order of the steps is not critical, but advantages exist with the preferred sequence. One advantage of the preferred sequence is that as soon as the golfer's swing frequency is measured, an existing inventory club can be selected and quickly sent to the golfer.

In the preferred first step, the manufacturing step, an array of inventory golf clubs is manufactured. Each club in the array has two known attributes: club length and club frequency. By making clubs of varied attributes an array of different clubs comes into existence.

Club length is loosely related to the type of club: for example a 9 iron has a standard length, usually 36 inches. However, it is possible to have an overlap of lengths and types for tall or short golfers. There may be, for example, two or more 7 iron lengths, one of which is the same length as one or more other clubs, such as the 6 and 8 irons.

For each club length there are preferably clubs in the inventory array having different club frequencies. If, for each club length X there are Y clubs of different natural frequency, the minimum number of inventory clubs in the array will be XY. This will form a two-dimensional array of clubs, each club differing from every other club by club length or club frequency or both.

The range of club lengths in the preferred inventory array is from 36 inches to 43½ inches, in discrete intervals of preferably one-half inch. For each club length, there are multiple clubs having a frequency preferably ranging from between 216 cycles per minute to 384 cycles per minute in discrete intervals of eight cycles per minute. These intervals can be varied depending upon the desired value of accuracy versus the number of clubs maintained in inventory.

The data representing the attributes of the inventory clubs are arranged in a two-dimensional array of attribute values, but this does not necessarily mean that to practice the invention, a person must form an array having a physical form, such as a graph. The array is a relation of the values of club length and club frequency. The preferred embodiment, however, does use a graph of club frequency plotted against club length, as shown in FIG. 1. At most of the intersections along the horizontal and vertical lines of FIG. 1 at least one inventory club preferably exists having those attributes represented by the position on the graph. Club length is plotted along the X axis at half inch intervals. Club frequency is plotted along the Y axis in the units of cycles per minute at 8 cycle per minute intervals. FIG. 1 is referred to in greater detail below in the description of the third step of the invention.

The second step in the preferred embodiment is the step of measuring. This step involves measuring the swing frequency of a golfer with a device like that described in U.S. Pat. No. 5,351,952. This patent describes the use of an accelerometer attached to a test club which the golfer swings through his normal golf swing.

In the preferred embodiment, the golfer swings a plurality of golf clubs, each club of a different length, generally corresponding to the different types of clubs in a set. An average swing frequency is obtained for each club length swung and that average swing frequency value is stored along with the length value (measured in inches) of the particular test club.

In the preferred embodiment, the golfer first tests three clubs, preferably the shortest, longest and an intermediate test club length of the range of club lengths he will later select. For example, the golfer who will later select all clubs in a set would swing a nine iron, three iron and a driver (one wood) to give swing frequencies of clubs of varied lengths. If the data obtained from swinging the three clubs are graphed and do not form a straight line, some intermediate club lengths such as the five wood and the six iron should be tested. If the data points obtained are graphed and form a curve, it is preferred that five data points be obtained. If a line is formed, three data points are preferred.

Although the above is preferred, it is within the scope of this invention to measure a golfer's swing frequency for only one test club, swung once or a plurality of times. It is also within the scope of this invention to measure the swing frequency of a golfer swinging a plurality of test clubs only one time each, or multiple times each. The more times a particular test club is swung, the more accurate the average swing frequency for a golf club having the length of the test club will become. In the preferred embodiment, the golfer swings each test club several times.

Furthermore, it is possible to test the swing frequency for test clubs having lengths corresponding to only a portion of the clubs in a set. If, for example, 13 clubs are desired to be matched to the golfer's swing, test clubs representing every other club length can be swung for a compromise between accuracy and time consumed in measuring. But it is possible to measure the golfer's swing frequency for only the longest and the shortest test clubs. In this way, less testing is necessary and the intermediate club frequencies can be estimated or mathematically interpolated. The number of test club lengths swung should increase as the desire for accuracy in matching a club and a golfer's swing increases.

The step of selecting is the preferred third step in the process. This step involves selecting an inventory club having a length preferably the same as (but alternatively acceptably close to) the test club length. The selected club will be the club in the two-dimensional array having a frequency closest to the golfer's swing frequency for that particular test club length. Since the club frequencies in the preferred two-dimensional array shown in FIG. 1 fall along discrete frequency intervals separated by eight cycle per minute gaps, the golfer's swing frequency for a particular club length will most likely be within the gap between two bracketing inventory club frequencies rather than exactly at one of the inventory club frequencies. The two bracketing club frequencies for that club length are compared, and the inventory club having club frequency closest to the golfer's swing frequency is selected. Of course, if the golfer's club frequency is exactly equal to an inventory club frequency for that club length, then that inventory club is selected.

The step of selecting involves the comparison of data. For each test club swung by the golfer, an average swing frequency is obtained. As described above, the average swing frequency is stored accompanied by a number representing the length of the test club. The selecting step involves comparing the test club swing data to each inventory club (having the same or substantially the same club length as the test club) to determine which inventory club of that length has a frequency closest to that golfer's swing frequency.

The accuracy of this method is very good. The inventory golf club selected using the present invention will differ from the golfer's swing frequency for the club of the particular length by no greater than four cycles per minute. This difference is limited to four cycles per minute since the inventory golf clubs for each club length differ by eight cycles per minute. Even if a golfer's swing frequency is numerically half-way between the frequencies of two inventory clubs for a particular length, the inventory club selected will differ from the golfer's swing frequency by four cycles per minute at the most, since 4 is half of 8. Of course, this difference could be increased or decreased if greater or lesser accuracy is needed.

As mentioned above, it is possible to measure the swing frequency of a golfer's swing for fewer than all of the club lengths for which an inventory club will later be selected. For example, if a whole set of clubs is to be selected, but only the 9 iron, 5 iron, 1 iron and 3 wood are tested, clubs of those tested lengths (and untested lengths in between like the 7 and 8 iron) can be selected from the inventory array. All that is necessary to select the untested club lengths is either "curve fitting" of the data if it is plotted on a graph, or interpolation of nonplotted data. Curve fitting is described first.

Referring to FIG. 1, the data points 1, 2, 3 and 4 represent the club lengths that have been tested for a particular golfer. If the inventory clubs most closely approximating the golfer's swing frequency represented by data points 10–22 are to be selected, a curve connecting the points 1–4 is drawn and the intersection points of the curve and each line representing a club length to be selected is obtained. The particular club frequency for each intersection point is then obtained. Then the inventory club having a frequency closest to the intersection point is selected. This is an example of using a curve fit to the data to obtain the frequency of untested club lengths.

If an alternative to the physical arrangement of the data on a graph is used, interpolation is necessary to obtain the frequencies for untested club lengths. A data structure forming a two-dimensional array can be stored in a computer. In this case, numerical analysis of the data is performed in order to obtain the frequency values of the untested club lengths. This numerical analysis is performed to obtain the inventory club frequency values in a way different from those values obtained by curve fitting the data points. But both methods should obtain similar results.

In the example above, the 9 iron, 5 iron, 1 iron and 3 wood were tested for a golfer's swing frequency. Average swing frequencies were obtained for each of these particular test club lengths. These average swing frequencies are next compared to attributes of inventory clubs represented in a two-dimensional data structure. One possible two-dimensional array of inventory clubs in a computer data structure is represented in the form shown in Table 1. Table 1 shows the data arranged in the form shown for demonstrative purposes. This data, if stored in a computer, would likely be in binary code. In Table 1, the inventory club data are organized in the form (length, frequency) and some data are not shown for purposes of brevity. The data between frequencies 224 and 384 are represented by ellipses, since their values can be obtained by the pattern established with the existing data and the description of the preferred embodiment.

TABLE 1

| | | | | |
|---|---|---|---|---|
| 9 iron: | (36, 216) | (36, 224) | . . . | (36, 384) |
| 8 iron: | (36.5, 216) | (36.5, 224) | . . . | (36.5, 384) |
| 7 iron: | (37, 216) | (37, 224) | . . . | (37, 384) |
| 6 iron: | (37.5, 216) | (37.5, 224) | . . . | (37.5, 384) |
| 5 iron: | (38, 216) | (38, 224) | . . . | (38, 384) |
| 4 iron: | (38.5, 216) | (38.5, 224) | . . . | (38.5, 384) |
| 3 iron: | (39, 216) | (39, 224) | . . . | (39, 384) |
| 2 iron: | (39.5, 216) | (39.5, 224) | . . . | (39.5, 384) |
| 1 iron: | (40, 216) | (40, 224) | . . . | (40, 384) |
| 5 wood: | (41.5, 216) | (41.5, 224) | . . . | (41.5, 384) |
| 3 wood: | (42.5, 216) | (42.5, 224) | . . . | (42.5, 384) |
| 1 wood: | (43.5, 216) | (43.5, 224) | . . . | (43.5, 384) |

If, as in the above example, the 9 iron, 5 iron, 1 iron, and 3 wood are tested by the golfer, the average swing frequency for each club length is obtained. For each club length desired to be selected, the swing frequency for that club length is compared to the frequencies of the inventory clubs of the same length in Table 1. The inventory club frequency most closely approximating the golfer's swing frequency for that club length will be selected. If the golfer's swing frequency for the 5 iron is, for example, 217 cycles per minute, the club selected is that inventory club having length of 38 inches and frequency of 216 cycles per minute.

The golfer's swing frequencies for the untested club lengths are obtained using numerical analysis. In the example in which the 9 iron and the 5 iron had been tested to obtain the golfer's swing frequency for each, the difference in the frequency between the two (frequency of the 9 iron minus frequency of the 5 iron) could be, most simply, divided by 4 since there are 4 gaps between the two tested and the three untested clubs between the 9 iron and the 5 iron. The frequency difference value could be positive or negative depending on the data. For the 8 iron one-fourth of this frequency difference value is then subtracted from the swing frequency for the 9 iron to obtain an approximate value for the golfer's swing frequency for the 8 iron. One-half of this difference is subtracted from the frequency for the 9 iron to arrive at the frequency for the 7 iron. For the 6 iron, three-fourths of the difference is subtracted from the frequency for the 9 iron. In this numerical analysis method, the club frequency difference between the 9 iron and the intermediate club (7 iron) is proportional to the club length difference between the 9 iron and the 7 iron. More complex numerical analysis methods exist, and any method that interpolates intermediate values would serve this purpose.

Curves A, B and C of FIG. 1 are sample curves of plotted data obtained by measuring golfers' swings as described above. The frequency differences between the 9 iron and 5 iron lengths for each curve A, B and C is approximately 22, 25, and −9 cpm, respectively (read from the graph), since the frequency differences are obtained for each curve by subtracting the frequency of the 5 iron from the frequency of the 9 iron.

The data which are obtained by measuring (the second step of the preferred embodiment) the golfer's swing frequency of test clubs and the data representing the attributes of the inventory clubs could be stored in many ways. These data could be stored in tabular form or on a graph in physical space, or in a magnetic medium, such as magnetic tape or disk. These data could alternatively be stored in a computer's random access memory (RAM), in the data storage of a compact disk, or any other analogous electronic storage medium. Any of these methods of storing data and others not mentioned are considered by the present invention to be computer memory if they are stored data which a computer can access.

In the preferred embodiment, the inventory array is made up of multiple clubs having identical or virtually identical attributes. The two-dimensional array of clubs is made three-dimensional by adding other clubs having identical attributes. The number of clubs having identical attributes is determined by an estimate or a calculation of the demand by the golfing public for each club having those particular attributes. If there is greater demand for a club having, for example, a length of 37 inches and a natural frequency of 288 cycles per minutes, more of these clubs will be maintained in the inventory array than clubs having attributes of less demand. The demand for a club having particular attributes can be determined by testing the golf swings of a portion of the population, by estimating the typical club frequencies for each club length, or by historical demand compiled over a period of time using the present invention.

Figure 2:
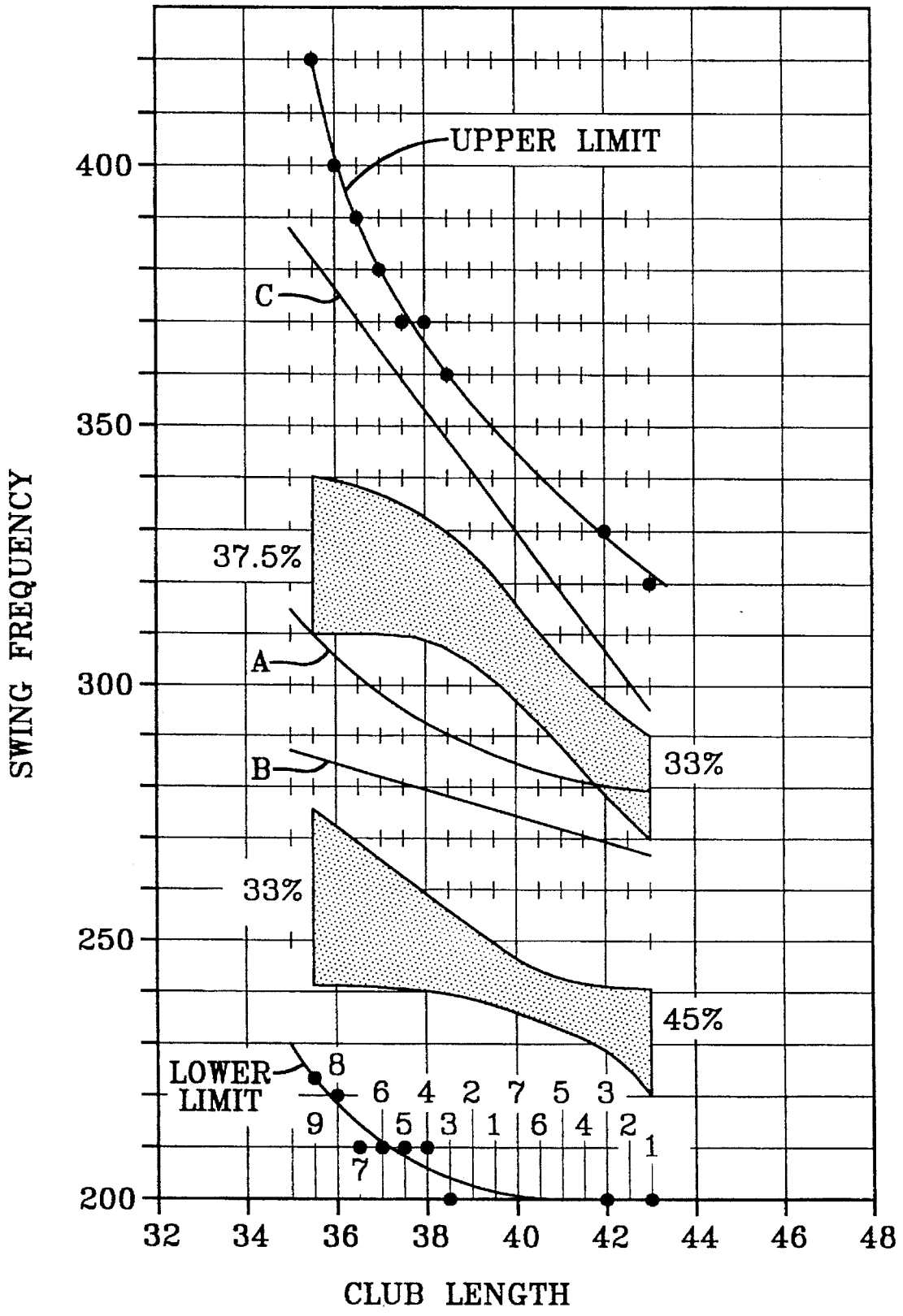
FIG. 2 is a graph illustrating sample zones of high golfer population.
Figure 3:
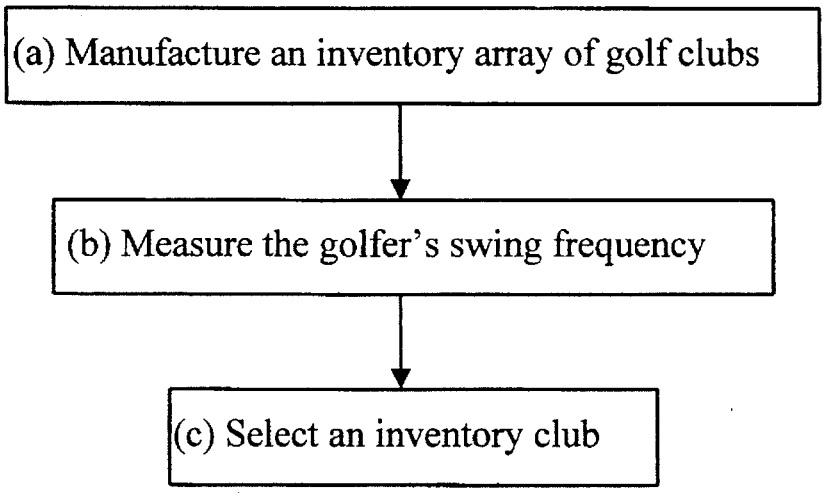
FIG. 3 is a flow chart representing the steps of claim 1.
Figure 4:
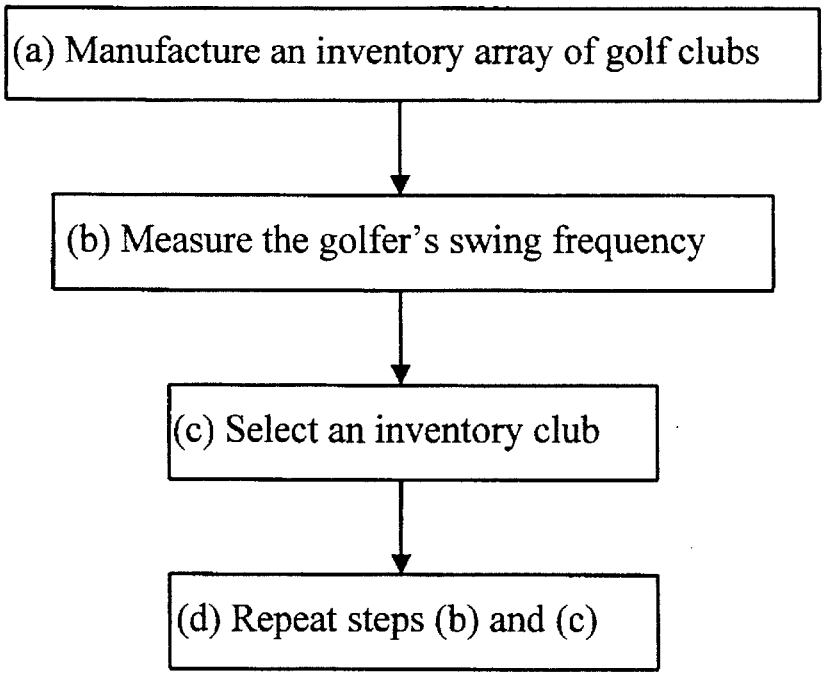
FIG. 4 is a flow chart representing the steps of claim 2.
Figure 5:
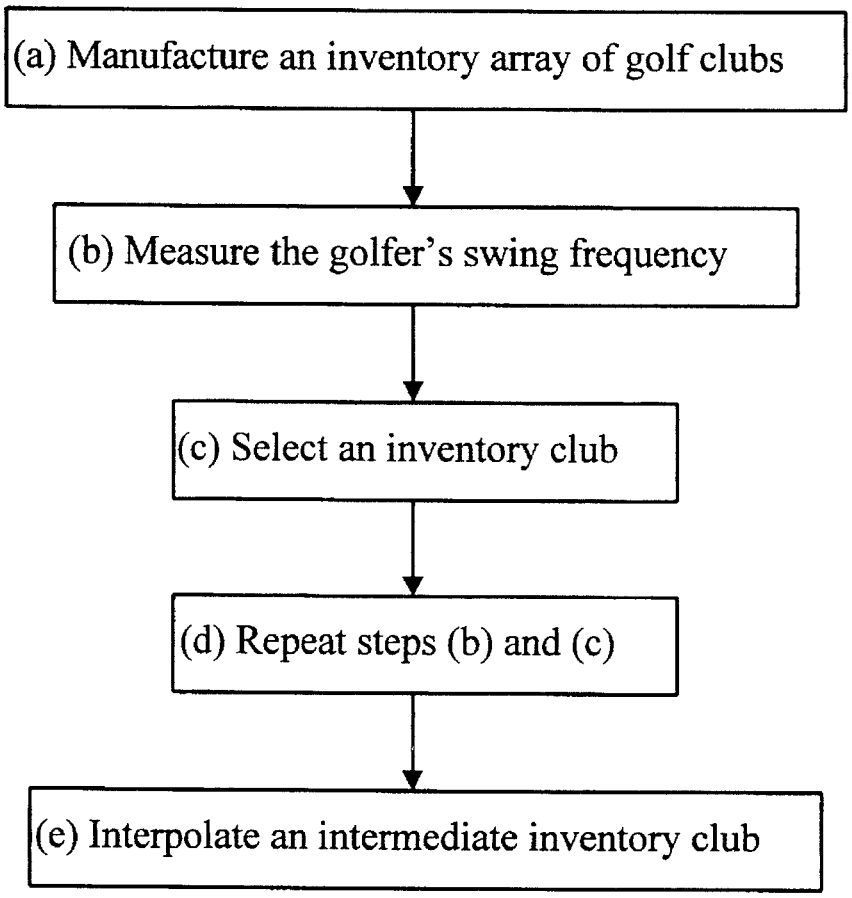
FIG. 5 is a flow chart representing the steps of claim 3.
Figure 6:
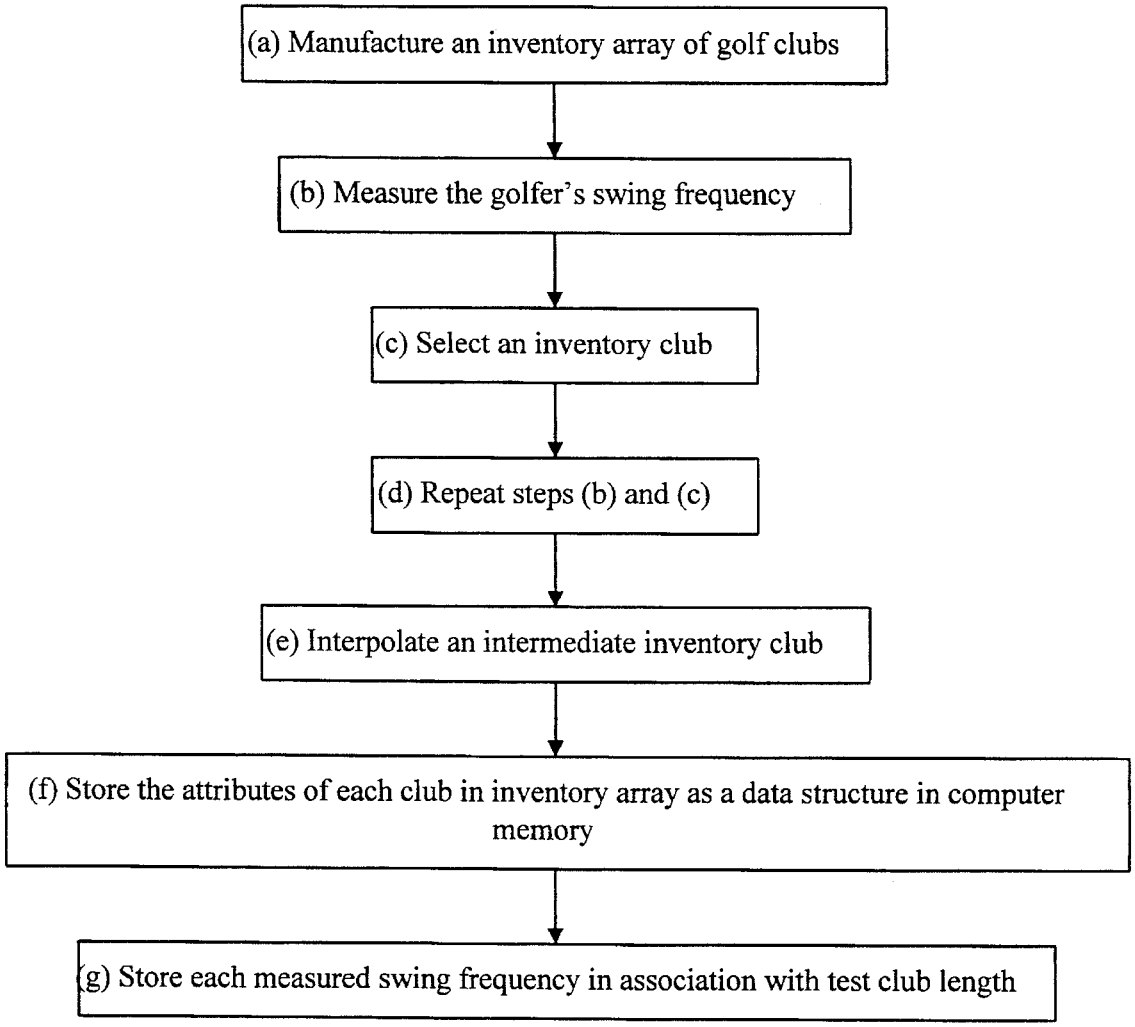
FIG. 6 is a flow charm representing the steps of claim 6.
Figure 7:
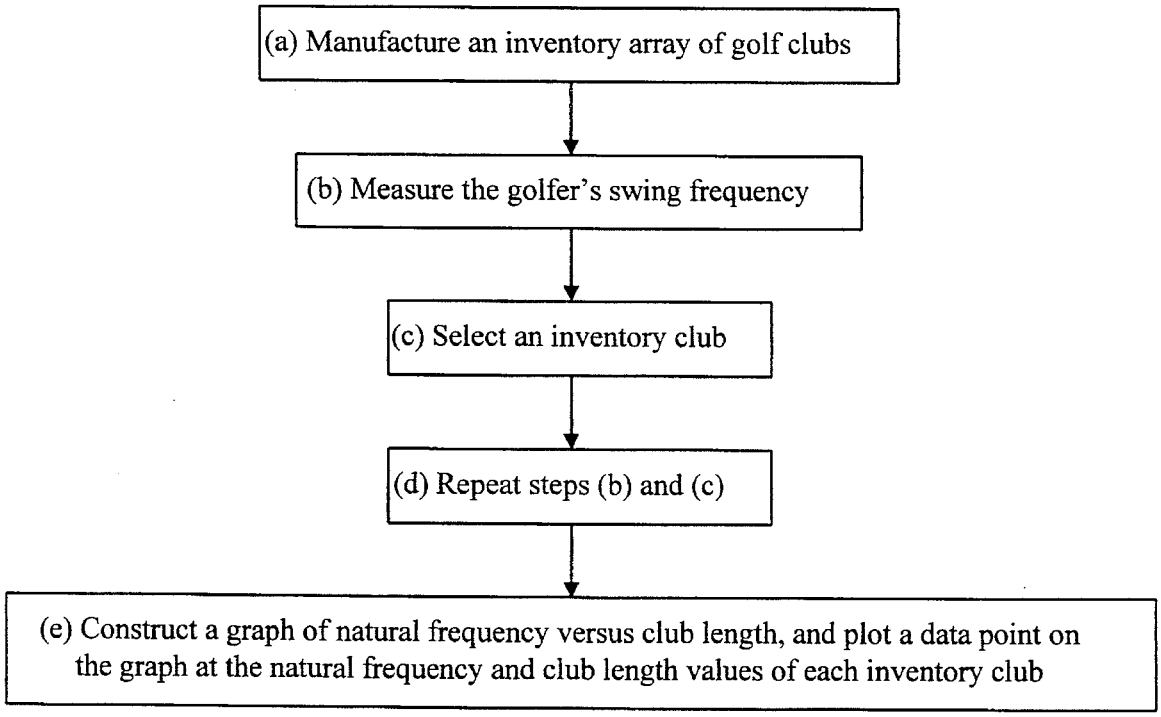
FIG. 7 is a flow chart representing the steps of claim 7.
Figure 8:
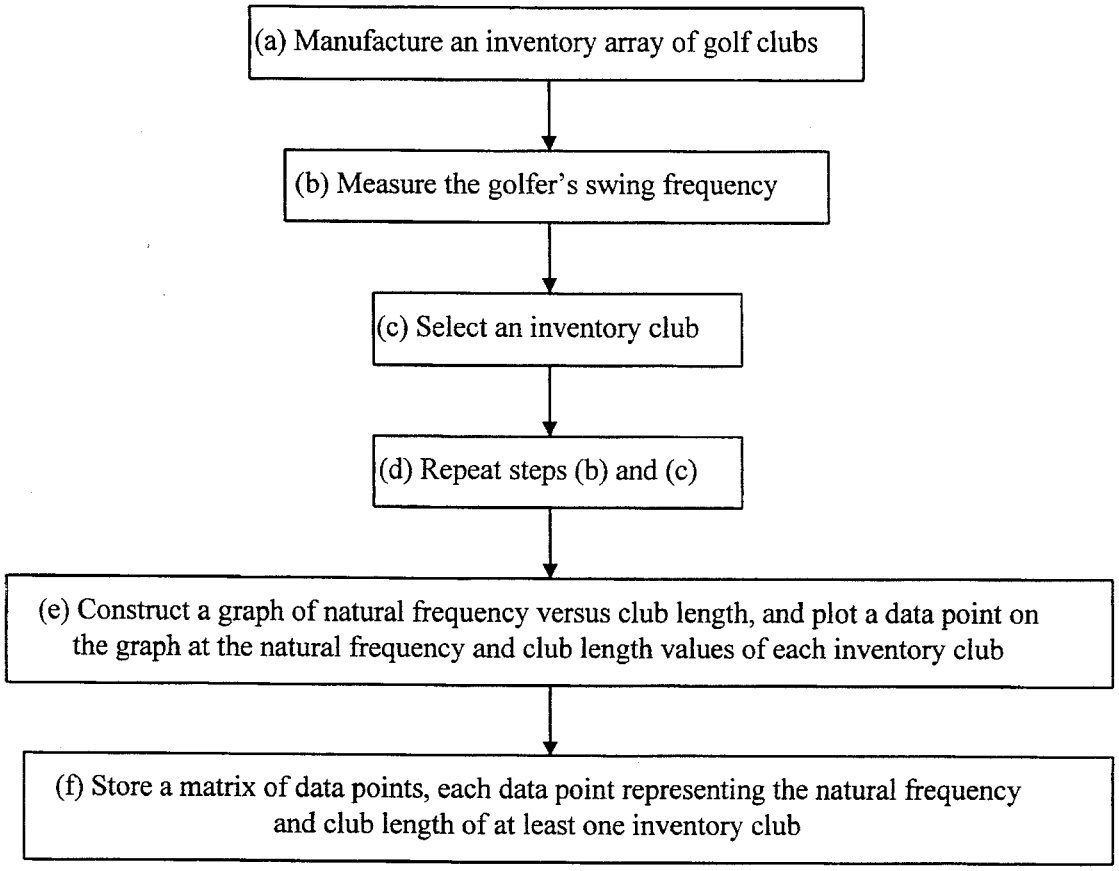
FIG. 8 is a flow chart representing the steps of claim 8.
Figure 9:
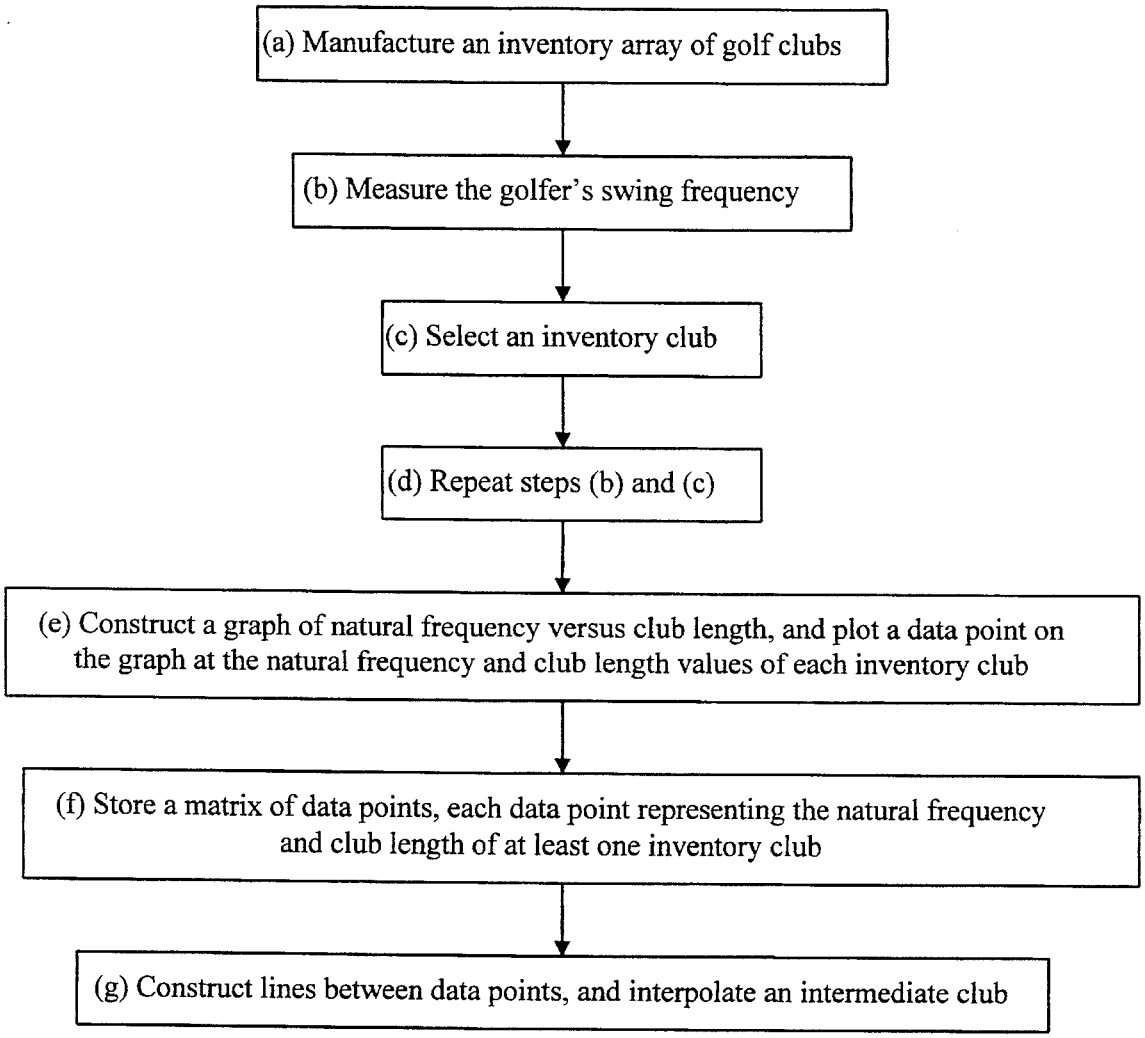
FIG. 9 is a flow chart representing the steps of claim 10.

FIG. 2 is a graph of frequency versus club length in which the darkened areas represent regions of the two dimensional array in which can be predicted there will be high demand. This graph was constructed by obtaining the swing frequencies of 50 people and plotting a point for each swing. Approximately 70% of the data points are within the darkened areas. Since the characteristics of the general population can be estimated by the characteristics of people in this sample, it is predictable that the general population will demand clubs having attributes falling within the darkened regions. Therefore, more clubs falling within those regions will be maintained in inventory. The upper and lower limits for the 50 swings are also illustrated in FIG. 2. Few clubs having attributes falling above these limits will be inventoried, since it is predictable that there will low demand for these clubs.

While certain preferred embodiments of the present invention have been disclosed in detail, it is to be understood that various modifications may be adopted without departing from the spirit of the invention or scope of the following claims.

I claim:

1. A method for matching a golfer to an inventory golf club, the method comprising:

(a) manufacturing an inventory array of golf clubs, each inventory club having attributes of club length and final natural frequency, the inventory of clubs including clubs at discrete intervals of length and at discrete intervals of frequency in a two dimensional array of club length and club frequency attributes; and then (b) measuring the swing frequency of the golfer's swing with a test club having a club length substantially equal to the length of an inventory club; and then (c) selecting for the golfer an inventory club having a length substantially equal to the test club length and having a natural frequency closer to the golfer's measured swing frequency than any other club in the inventory array which has length substantially equal to the test club length.

2. A method in accordance with claim 2, wherein steps (b) and (c) are repeated for a plurality of different club lengths.

3. A method in accordance with claim 2 and further comprising interpolating at least one intermediate inventory club from the inventory array of clubs, said intermediate inventory club having a club length and a club frequency different from a length and a frequency of a first test club for which the natural frequency was measured, the difference between the frequencies of the intermediate and test clubs being substantially proportional to the difference between the lengths of the intermediate and test clubs.

4. A method in accordance with claim 3, wherein the discrete intervals of length in the array are between one fourth inch and one inch, and the discrete intervals of frequency are between 4 and 12 cycles per minute.

5. A method in accordance with claim 4, wherein the discrete intervals of club length are one half inch and the discrete intervals of frequency are 8 cycles per minute.

6. A method in accordance with claim 5 and further comprising:

(a) storing the length and frequency attributes of each club in the inventory array of clubs as a data structure in a memory of a computer having a central processor, display and interfacing input and output peripherals; and (b) storing each measured swing frequency in association with the test club length for each measured frequency.

7. A method in accordance with claim 2, further comprising constructing a graph of natural frequency versus club length and plotting a data point on the graph at the natural frequency and club length values of each inventory club.

8. A method in accordance with claim 7, further comprising storing a matrix of data points, each data point representing the natural frequency and club length of at least one inventory club, the data points spaced apart at discrete intervals of between one fourth inch and one inch of club length and between 4 and 12 cycles per minute of frequency.

9. A method in accordance with claim 8, wherein the discrete intervals of club length are one half inch and the discrete intervals of frequency are 8 cycles per minute.

10. A method in accordance with claim 9 and further comprising the step of constructing lines between data points and the step of interpolating at least one intermediate inventory club having a club length and a club frequency different from a length and a frequency of a first test club, the difference between the frequencies of the intermediate and test clubs being substantially proportional to the difference between the lengths of the intermediate and test clubs.

11. A method in accordance with claim 1, further comprising:

(a) measuring the swing frequency of the golfer's swing with three test clubs, a first test club having length shorter than the others, a second test club having length intermediate the others and a third test club having length greater than the others;

(b) plotting a data point on a graph of frequency versus club length for each of the three clubs; and (c) selecting for the golfer a set of clubs from the inventory array.

12. A method in accordance with claim 1 wherein the manufacturing step further comprises manufacturing an array of clubs of standard club length.

* * * * *